US012766374B2

(12) United States Patent
Spackman et al.

(10) Patent No.: US 12,766,374 B2
(45) **Date of Patent: *Oct. 20, 2026**

(54) GOLF CLUB HEADS COMPRISING A THERMOPLASTIC COMPOSITE MATERIAL

(71) Applicant: KARSTEN MANUFACTURING CORPORATION, Phoenix, AZ (US)

(72) Inventors: Clayson C. Spackman, Scottsdale, AZ (US); Jeremy S. Pope, Overland Park, KS (US); Tyler A. Shaw, Paradise Valley, AZ (US); Eric J. Morales, Laveen, AZ (US); Atiqah Shahrin, Kuala Lumpur (MY)

(73) Assignee: Karsten Manufacturing Corporation, Phoenix, AZ (US)

( * ) Notice: Subject to any disclaimer, the term of this patent is extended or adjusted under 35 U.S.C. 154(b) by 284 days.

This patent is subject to a terminal disclaimer.

(21) Appl. No.: 18/440,754

(22) Filed: Feb. 13, 2024

(65) Prior Publication Data

US 2024/0181306 A1 Jun. 6, 2024

Related U.S. Application Data

(63) Continuation of application No. 17/649,314, filed on Jan. 28, 2022, now Pat. No. 11,896,879, which is a (Continued)

(51) Int. Cl.
*A63B 53/04* (2015.01)

(52) U.S. Cl.
CPC ..... *A63B 53/0466* (2013.01); *A63B 53/04* (2013.01); *A63B 53/0408* (2020.08); (Continued)

(58) Field of Classification Search
CPC ..... A63B 53/0466; A63B 2209/023; A63B 2209/02; A63B 53/04; A63B 53/042; (Continued)

(56) References Cited

U.S. PATENT DOCUMENTS 4,581,190 A 4/1986 Nagamoto et al.
4,664,383 A 5/1987 Aizawa
(Continued)

FOREIGN PATENT DOCUMENTS

EP 0891790 1/1999
JP 2004024734 1/2004
(Continued)

OTHER PUBLICATIONS

E9 Face Technology With Dual Roll—Multi-material Construction, Cobra Golf, accessed Oct. 19, 2017; https://www.cobragolf.com/pumagolf/tech--overview.
(Continued)

*Primary Examiner* — Sebastiano Passaniti

(57) ABSTRACT

A golf club head includes a front body and a rear body coupled to the front body to define a hollow cavity therebetween. The front body includes a strike face that defines a ball striking surface, a hosel, and a frame that at least partially surrounds the strikeface and extends rearward from a perimeter of the strikeface away from the ball striking surface. The strike face and frame are formed from a thermoplastic composite comprising a thermoplastic polymer having a plurality of discontinuous fibers embedded therein. Each of the plurality of discontinuous fibers have a length between about 0.01 mm and 3 mm. In some embodiments, the thermoplastic composite is 30% to 70% fibers by volume.

18 Claims, 5 Drawing Sheets

Related U.S. Application Data continuation of application No. 16/949,224, filed on Oct. 20, 2020, now Pat. No. 11,235,210, which is a continuation of application No. 16/252,317, filed on Jan. 18, 2019, now Pat. No. 10,806,977.

(60) Provisional application No. 62/781,509, filed on Dec. 18, 2018, provisional application No. 62/770,000, filed on Nov. 20, 2018, provisional application No. 62/718,857, filed on Aug. 14, 2018, provisional application No. 62/703,305, filed on Jul. 25, 2018, provisional application No. 62/702,996, filed on Jul. 25, 2018, provisional application No. 62/644,319, filed on Mar. 16, 2018, provisional application No. 62/619,631, filed on Jan. 19, 2018.

(52) U.S. Cl.
CPC ..... *A63B 53/0416* (2020.08); *A63B 53/042* (2020.08); *A63B 53/0425* (2020.08); *A63B 53/0429* (2020.08); *A63B 53/0437* (2020.08); *A63B 53/0462* (2020.08); *A63B 2209/02* (2013.01); *A63B 2209/023* (2013.01)

(58) Field of Classification Search
CPC ..... A63B 53/0408; A63B 53/0416; A63B 53/0425; A63B 53/0429; A63B 53/0437; A63B 53/0462
USPC ..... 473/324–350, 287–292
See application file for complete search history.

(56) References Cited

U.S. PATENT DOCUMENTS 5,068,281 A 11/1991 Okumura
5,080,366 A 1/1992 Okumoto et al.
5,193,811 A 3/1993 Okumoto et al.
5,328,176 A 7/1994 Lo
5,377,986 A 1/1995 Viollaz
5,445,382 A 8/1995 Pearce
5,586,949 A 12/1996 Aizawa
5,614,143 A 3/1997 Hager
5,624,331 A 4/1997 Lo et al.
5,669,827 A 9/1997 Nagamoto
5,938,543 A 8/1999 McGeeney
6,354,962 B1 3/2002 Galloway et al.
6,354,963 B1 3/2002 Kodama et al.
6,368,234 B1 4/2002 Galloway
6,381,828 B1 5/2002 Boyce et al.
6,390,933 B1 5/2002 Galloway et al.
6,435,977 B1 8/2002 Helmstetter et al.
6,435,980 B1 8/2002 Reyes
6,440,011 B1 8/2002 Hocknell et al.
6,471,604 B2 10/2002 Hocknell et al.
6,491,592 B2 12/2002 Cackett et al.
6,565,452 B2 5/2003 Helmstetter et al.
6,575,845 B2 6/2003 Galloway et al.
6,582,323 B2 6/2003 Soracco et al.
6,602,149 B1 8/2003 Jacobson
6,605,007 B1 8/2003 Bissonnette et al.
6,648,774 B1 11/2003 Lee
6,663,504 B2 12/2003 Hocknell et al.
6,739,982 B2 5/2004 Murphy et al.
6,739,983 B2 5/2004 Helmstetter et al.
6,743,118 B1 6/2004 Soracco
6,758,763 B2 7/2004 Murphy et al.
6,860,823 B2 3/2005 Lee
6,860,824 B2 3/2005 Evans
6,926,619 B2 8/2005 Helmstetter et al.
6,929,565 B2 8/2005 Nakahara et al.
6,945,876 B2 9/2005 Nakahara
6,994,637 B2 2/2006 Murphy et al.
7,025,692 B2 4/2006 Erickson et al.
7,029,403 B2 4/2006 Rice et al.
7,059,973 B2 6/2006 Erickson et al.
7,066,835 B2 6/2006 Evans et al.
7,108,614 B2 9/2006 Lo
7,115,047 B2 10/2006 Stevens et al.
7,118,493 B2 10/2006 Galloway
7,121,955 B2 10/2006 Stevens et al.
7,121,957 B2 10/2006 Hocknell et al.
7,125,344 B2 10/2006 Hocknell et al.
7,128,661 B2 10/2006 Soracco et al.
7,128,664 B2 10/2006 Onoda
7,137,907 B2 11/2006 Gibbs et al.
7,144,333 B2 12/2006 Murphy et al.
7,147,576 B2 12/2006 Imamoto et al.
7,163,470 B2 1/2007 Galloway et al.
7,166,038 B2 1/2007 Williams et al.
7,175,541 B2 2/2007 Lo
7,214,142 B2 5/2007 Meyer et al.
7,252,599 B2 8/2007 Hasegawa
7,252,600 B2 8/2007 Murphy et al.
7,255,654 B2 8/2007 Murphy et al.
7,258,624 B2 8/2007 Kobayashi
7,258,625 B2 8/2007 Kawaguchi et al.
7,261,645 B2 8/2007 Oyama
7,297,072 B2 11/2007 Meyer et al.
7,303,487 B2 12/2007 Kumamoto
7,318,782 B2 1/2008 Imamoto et al.
7,320,646 B2 1/2008 Galloway
7,338,390 B2 3/2008 Lindsay
7,344,452 B2 3/2008 Imamoto et al.
7,367,900 B2 5/2008 Kumamoto
7,377,860 B2 5/2008 Breier et al.
7,387,577 B2 6/2008 Murphy et al.
7,402,112 B2 7/2008 Galloway
7,407,448 B2 8/2008 Stevens et al.
7,438,647 B1 10/2008 Hocknell
7,438,649 B2 10/2008 Ezaki et al.
7,448,964 B2 11/2008 Schweigert et al.
7,455,600 B2 11/2008 Imamoto et al.
7,468,005 B2 12/2008 Kouno et al.
7,470,201 B2 12/2008 Nakahara et al.
7,491,134 B2 2/2009 Murphy et al.
7,494,424 B2 2/2009 Williams et al.
7,497,788 B2 3/2009 Imamoto et al.
7,497,789 B2 3/2009 Burnett et al.
7,510,485 B2 3/2009 Yamamoto
7,520,822 B2 4/2009 Yamagishi et al.
7,524,249 B2 4/2009 Breier et al.
7,530,901 B2 5/2009 Imamoto et al.
7,530,903 B2 5/2009 Imamoto et al.
7,540,812 B2 6/2009 Imamoto et al.
7,568,982 B2 8/2009 Cackett et al.
7,582,248 B2 9/2009 Reyes et al.
7,591,737 B2 9/2009 Gibbs et al.
7,601,078 B2 10/2009 Mergy et al.
7,607,992 B2 10/2009 Nishio
7,632,193 B2 12/2009 Thielen
7,651,414 B2 1/2010 Rae
7,658,686 B2 2/2010 Soracco
7,674,187 B2 3/2010 Cackett et al.
7,691,008 B2 4/2010 Oyama
7,708,652 B2 5/2010 Cackett et al.
7,749,096 B2 7/2010 Gibbs et al.
7,749,103 B2 7/2010 Nakano
7,775,903 B2 8/2010 Kawaguchi et al.
7,785,212 B2 8/2010 Lukasiewicz, Jr. et al.
7,803,065 B2 9/2010 Breier et al.
7,854,364 B2 12/2010 DeShiell et al.
7,922,604 B2 4/2011 Roach et al.
7,931,546 B2 4/2011 Bennett et al.
7,938,740 B2 5/2011 Breier et al.
7,938,742 B2 5/2011 Galloway
7,946,929 B2 5/2011 Wahlin
7,959,523 B2 6/2011 Rae et al.
7,967,591 B2 6/2011 Reyes et al.
7,993,216 B2 8/2011 Lee
8,007,371 B2 8/2011 Breier et al.
8,012,041 B2 9/2011 Gibbs
8,025,591 B2 9/2011 De La Cruz et al.
8,197,357 B1 6/2012 Rice et al.

(56) References Cited

U.S. PATENT DOCUMENTS

| | | | |
|---|---|---|---|
| 8,197,358 | B1 | 6/2012 | Watson et al. |
| 8,221,261 | B2 | 7/2012 | Curtis et al. |
| 8,267,808 | B2 | 9/2012 | De La Cruz et al. |
| 8,303,433 | B2 | 11/2012 | Roach et al. |
| 8,308,582 | B2 | 11/2012 | Tanimoto |
| 8,376,876 | B2 | 2/2013 | Gibbs et al. |
| 8,388,464 | B2 | 3/2013 | Gilbert |
| 8,414,422 | B2 | 4/2013 | Peralta et al. |
| 8,419,569 | B2 | 4/2013 | Bennett et al. |
| 8,425,827 | B2 | 4/2013 | Lee |
| 8,435,137 | B2 | 5/2013 | Hirano |
| 8,444,506 | B2 | 5/2013 | Watson et al. |
| 8,460,123 | B1 | 6/2013 | Demille et al. |
| 8,491,416 | B1 | 7/2013 | Demille et al. |
| 8,506,421 | B2 | 8/2013 | Stites et al. |
| 8,517,859 | B2 | 8/2013 | Golden et al. |
| 8,523,705 | B2 | 9/2013 | Breier et al. |
| 8,540,588 | B2 | 9/2013 | Rice et al. |
| 8,556,746 | B1 | 10/2013 | DeMille et al. |
| 8,608,591 | B2 | 12/2013 | Chao et al. |
| 8,628,434 | B2 | 1/2014 | Chao |
| 8,632,419 | B2 | 1/2014 | Tang et al. |
| 8,632,420 | B2 | 1/2014 | Kawaguchi et al. |
| 8,696,489 | B2 | 4/2014 | Gibbs et al. |
| 8,702,534 | B2 | 4/2014 | DeMille et al. |
| 8,715,109 | B2 | 5/2014 | Bennett et al. |
| 8,727,911 | B2 | 5/2014 | DeMille et al. |
| 8,753,219 | B2 | 6/2014 | Gilbert |
| 8,753,226 | B2 | 6/2014 | Rice et al. |
| 8,790,196 | B2 | 7/2014 | Solheim et al. |
| 8,814,723 | B2 | 8/2014 | Tavares et al. |
| 8,858,362 | B1 | 10/2014 | Leposky et al. |
| 8,870,680 | B2 | 10/2014 | Yamamoto |
| 8,870,683 | B2 | 10/2014 | Hettinger et al. |
| 8,876,629 | B2 | 11/2014 | Deshmukh et al. |
| 8,926,450 | B2 | 1/2015 | Takahashi et al. |
| 8,938,871 | B2 | 1/2015 | Roach et al. |
| 8,939,848 | B2 | 1/2015 | Soracco |
| 8,956,248 | B2 | 2/2015 | Demille |
| 8,979,671 | B1 | 3/2015 | DeMille et al. |
| 9,033,818 | B2 | 5/2015 | Myrhum et al. |
| 9,033,822 | B1 | 5/2015 | DeMille et al. |
| 9,079,368 | B2 | 7/2015 | Tavares et al. |
| 9,168,435 | B1 | 10/2015 | Boggs et al. |
| 9,174,098 | B2 | 11/2015 | Hayase et al. |
| 9,192,826 | B2 | 11/2015 | Golden et al. |
| 9,199,137 | B2 | 12/2015 | Deshmukh et al. |
| 9,320,949 | B2 | 4/2016 | Golden et al. |
| 9,352,198 | B2 | 5/2016 | Roach et al. |
| 9,393,465 | B2 | 7/2016 | Stokke et al. |
| 9,399,157 | B2 | 7/2016 | Greensmith et al. |
| 9,427,631 | B1 | 8/2016 | Larson et al. |
| 9,457,245 | B2 | 10/2016 | Lee |
| 9,504,883 | B2 | 11/2016 | DeMille et al. |
| 9,526,955 | B2 | 12/2016 | DeMille et al. |
| 9,533,200 | B2 | 1/2017 | Dolezel et al. |
| 9,545,548 | B2 | 1/2017 | Petersen |
| 9,579,548 | B2 | 2/2017 | Boyd et al. |
| 9,586,104 | B2 | 3/2017 | Roach |
| 9,682,291 | B2 | 6/2017 | Chao |
| 9,682,299 | B2 | 6/2017 | Tang et al. |
| 9,717,960 | B2 | 8/2017 | Deshmukh et al. |
| 9,724,573 | B2 | 8/2017 | Kawaguchi et al. |
| 9,833,666 | B2 | 12/2017 | Boggs et al. |
| 9,849,347 | B2 | 12/2017 | Sander |
| 9,861,866 | B2 | 1/2018 | DeMille et al. |
| 9,908,014 | B1 | 3/2018 | Wester et al. |
| 9,925,432 | B2 | 3/2018 | Morales et al. |
| 9,950,220 | B2 | 4/2018 | Larson |
| 9,975,022 | B2 | 5/2018 | Boggs |
| 10,016,662 | B1 | 7/2018 | Wester |
| 10,046,212 | B2 | 8/2018 | Sargent et al. |
| 10,137,335 | B2 | 11/2018 | Hope |
| 10,143,898 | B2 | 12/2018 | Cornelius et al. |
| 10,300,354 | B2 | 5/2019 | Morales et al. |
| 10,357,901 | B2 | 7/2019 | Deshmukh et al. |
| 10,556,161 | B2 | 2/2020 | Jertson |
| 10,806,977 | B2 | 10/2020 | Spackman et al. |
| 11,235,210 | B2 | 2/2022 | Spackman |
| 11,896,879 | B2 * | 2/2024 | Spackman ..... A63B 53/0466 |
| 2003/0186760 | A1 | 10/2003 | Lee |
| 2004/0033844 | A1 | 2/2004 | Chen |
| 2004/0116207 | A1 | 6/2004 | De Shiell et al. |
| 2005/0026719 | A1 | 2/2005 | Yang |
| 2005/0043115 | A1 | 2/2005 | Lin |
| 2005/0143189 | A1 | 6/2005 | Lai et al. |
| 2005/0159239 | A1 | 7/2005 | Imamoto et al. |
| 2005/0233831 | A1 | 10/2005 | Ezaki et al. |
| 2006/0052181 | A1 | 3/2006 | Serrano et al. |
| 2006/0229141 | A1 | 10/2006 | Galloway |
| 2007/0155533 | A1 | 7/2007 | Solheim et al. |
| 2008/0293512 | A1 | 11/2008 | Chen |
| 2010/0178996 | A1 | 7/2010 | Chao |
| 2013/0225320 | A1 | 8/2013 | Woolley et al. |
| 2016/0332040 | A1 | 11/2016 | Lafortune et al. |
| 2017/0128794 | A1 * | 5/2017 | Stokke ..... A63B 53/02 |

FOREIGN PATENT DOCUMENTS

| | | |
|---|---|---|
| JP | 2006271770 | 10/2006 |
| JP | 2013009713 | 1/2013 |
| TW | 398984 | 7/2000 |
| WO | 2007076304 | 7/2007 |

OTHER PUBLICATIONS

Taylormade M1 Driver, Multi-material Construction, accessed Jun. 7, 2016; http://www.intheholegolf.com/TM15-M1D/TaylorMade-M1-Driver.html.

Adams Men's Golf Speedline Super XTD Fairway Wood; Amazon, accessed Oct. 19, 2017; https://www.amazon.com/Adams-Golf-Speedline-SUPER-Fairway/dp/B007LI2S04.

Callaway Womens Great Big Bertha Driver, Amazon, accessed Oct. 19, 2017; https://www.amazon.com/Callaway-Womens-Great-Bertha-Driver/dp/B013SYR0VQ.

Nike Vapor Flex 440 Driver Adjustable Loft Golf Club Left Hand, accessed Jun. 7, 2016; http://www.globalgolf.com/golf-clubs/1034365-nike-vapor-flex-440-driver-left-hand/.

International Search Report and Written Opinion of the International Searching Authority from PCT Application No. PCT/US19/14321, dated May 9, 2019.

International Search Report and Written Opinion of the International Searching Authority from PCT Application No. PCT/US19/14326, dated May 23, 2019.

International Search Report and Written Opinion of the International Searching Authority from PCT Application No. PCT/US17/034807, dated Aug. 2, 2017.

* cited by examiner

GOLF CLUB HEADS COMPRISING A THERMOPLASTIC COMPOSITE MATERIAL

CROSS REFERENCE TO RELATED APPLICATIONS

This is a continuation of U.S. patent application Ser. No. 17/649,314, filed Jan. 28, 2022, which is a continuation of U.S. patent application Ser. No. 16/949,224, patented as U.S. Pat. No. 11,235,210, filed Oct. 20, 2020, which is a continuation of U.S. patent application Ser. No. 16/252,317, patented as U.S. Pat. No. 10,806,977, filed Jan. 18, 2019, which claims the benefit of U.S. Provisional Patent Nos. 62/619,631 filed 19 Jan. 2018; 62/644,319 filed 16 Mar. 2018; 62/702,996 filed 25 Jul. 2018; 62/703,305 filed 25 Jul. 2018; 62/718,857 filed 14 Aug. 2018; 62/770,000 filed 20 Nov. 2018; and 62/781,509 filed 18 Dec. 2018; the disclosure of each of the above-referenced applications and patents are incorporated by reference in their entirety.

TECHNICAL FIELD

The present disclosure relates to a golf club head having one or more components comprising a thermoplastic composite material.

BACKGROUND

In an ideal club design, the amount of structural mass would be minimized (without sacrificing resiliency) to provide additional discretionary mass that can be strategically positioned to customize club performance. In general, the total of all club head mass is the sum of the structural mass and the discretionary mass. Structural mass generally refers to the mass of the materials that are required to provide the club head with the structural resilience needed to withstand repeated impacts. Structural mass is highly design-dependent, and provides little design control over specific mass distribution. Conversely, discretionary mass is any additional mass (beyond the minimum structural requirements) that may be added to the club head design for the sole purpose of customizing the performance and/or forgiveness of the club. Current golf club heads comprise metallic materials for at least a portion of the structural mass of the club head (for example, in the strike face and/or at least a portion of the rear body). There is a need in the art for alternative designs to golf club heads having structural mass comprising metal, to provide a means for maximizing discretionary weight to maximize club head moment of inertia (MOI) and lower/back center of gravity (CG).

While this provided background description attempts to clearly explain certain club-related terminology, it is meant to be illustrative and not limiting. Custom within the industry, rules set by golf organizations such as the United States Golf Association (USGA) or The R&A, and naming convention may augment this description of terminology without departing from the scope of the present application.

DETAILED DESCRIPTION

Figure 1:
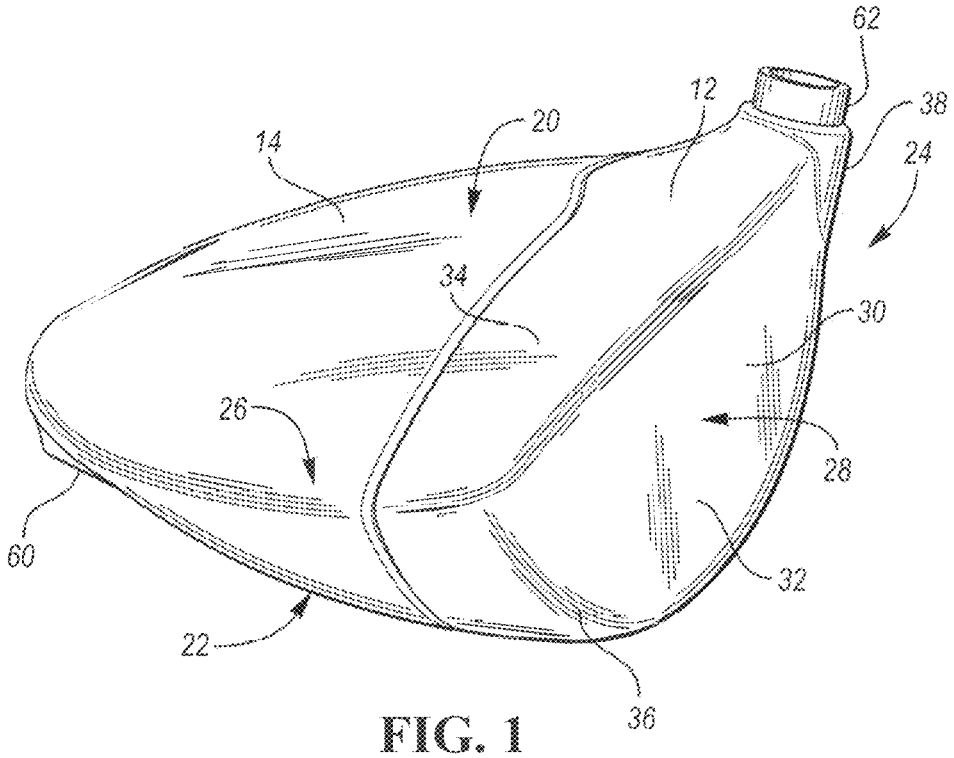
FIG. 1 is a schematic perspective view of a golf club head.

The present disclosure generally relates to embodiments of a golf club head having one or more injection molded thermoplastic composite materials incorporated into the club head face and/or body to form a structural aspect of the club head. In doing so, the present designs effect a reduction in structural mass of the head when compared to an all-metal club head of a similar size, shape, and outward appearance. The additional discretionary mass that these designs provide is then available to a club head designer to be strategically placed around the head, for example, to increase the moment of inertia of the club head and/or to alter the relative location of the club head's center of gravity.

Since thermoplastic polymers have considerably lower strengths than most metals used in golf clubs, special attention must be paid to the design, material selection, and reinforcement within polymeric portions to avoid unexpected failure while still maintaining a dynamic response, sound, and feel that is expected by the golfer.

Embodiments discussed below further recognize that filled polymers can have anisotropic structural qualities, which are dependent on the typical or average orientation of the embedded, discontinuous fibers. More specifically, a filled polymeric component will generally have greater strength to loads aligned with the longitudinal axis of the embedded fibers, and comparatively less strength to loads applied laterally. Because fiber orientation within a filled polymer is highly dependent on mold flow during the initial part formation, embodiments described below utilize mold and part designs that aid in orienting the embedded fiber along the most likely force/stress propagation paths.

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; about or reasonably close to the value; nearly). If the imprecision provided by "about" is not otherwise understood in the art with this ordinary meaning, then "about" as used herein indicates at least variations that may arise from ordinary methods of measuring and using such parameters. In addition, disclosure of ranges includes disclosure of all values and further divided ranges within the entire range. Each value within a range and the endpoints of a range are hereby all disclosed as separate embodiment. The terms "comprises," "comprising," "including," and "having," are inclusive and therefore specify the presence of stated items, but do not preclude the presence of other items. As used in this specification, the term "or" includes any and all combinations of one or more of the listed items. When the terms first, second, third, etc. are used to differentiate various items from each other, these designations are merely for convenience and do not limit the items.

The terms "loft" or "loft angle" of a golf club, as described herein, refers to the angle formed between the club face and the shaft, as measured by any suitable loft and lie machine.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes with general reference to a golf club held at address on a horizontal ground plane and at predefined loft and lie angles, though are not necessarily intended to describe permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements, mechanically or otherwise. Coupling (whether mechanical or otherwise) may be for any length of time, e.g., permanent or semi-permanent or only for an instant.

Other features and aspects will become apparent by consideration of the following detailed description and accompanying drawings. Before any embodiments of the disclosure are explained in detail, it should be understood that the disclosure is not limited in its application to the details or construction and the arrangement of components as set forth in the following description or as illustrated in the drawings. The disclosure is capable of supporting other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

General Club Head Structure

Figure 2A:
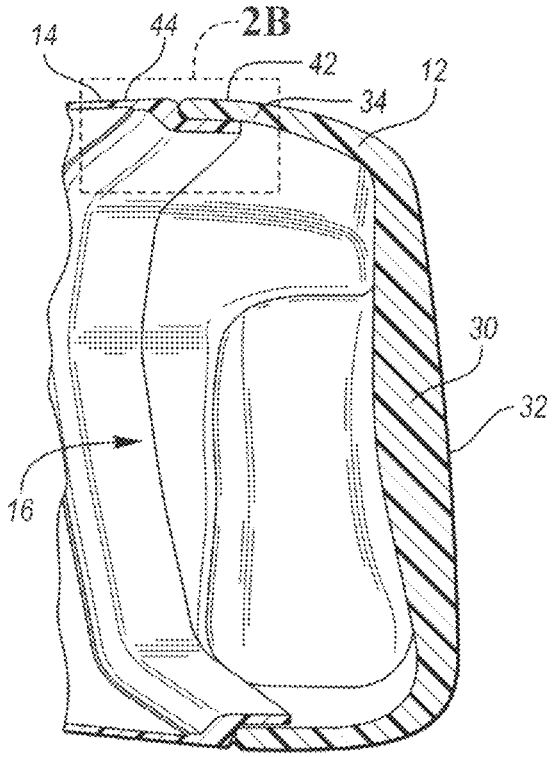
FIG. 2A is a schematic cross-sectional view of a forward portion of the golf club head of FIG. 1, taken along line 2-2.
Figure 2B:
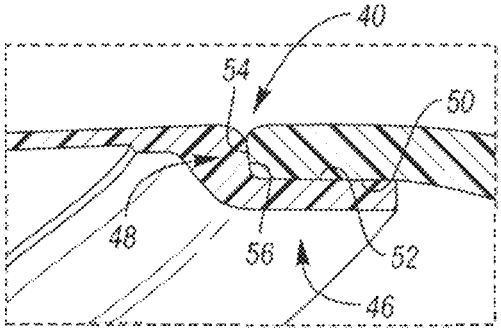
FIG. 2B is a schematic partial cross-sectional view of a forward portion of the golf club head of FIG. 1, taken along line 2-2.

Referring to the drawings, wherein like reference numerals are used to identify like or identical components in the various views, FIGS. 1, 2A, and 2B schematically illustrate an embodiment of a golf club head 10 that includes a front body portion 12 ("front body 12") and a rear body portion 14 ("rear body 14"). The front body 12 and rear body 14 are coupled together to define a substantially enclosed/hollow interior volume 16, such as shown in FIGS. 2A and 2B. As is conventional with wood-style heads, the golf club head 10 includes a crown 20 and a sole 22, and may be generally divided into a heel portion 24, a toe portion 26, and a central portion 28 that is located between the heel portion 24 and toe portion 26.

The front body 12 generally includes a strike face 30 that has a forward ball-striking surface 32, which is intended to impact a golf ball during a conventional swing. In some embodiments, the front body 12 may also include a frame 34 that surrounds and extends rearward from a perimeter 36 of the strike face 30 to provide the front body 12 with a cup-shaped appearance, and may further include a hosel 38 for receiving a golf club shaft or shaft adapter.

In a playable, completed club head 10, the front body 12 and the rear body 14 are integrally coupled at a joint 40, such as through one or more adhering, bonding, mechanical affixing, welding, or fusing operations. In one particular configuration, such as shown in FIGS. 2A and 2B, the joint 40 may be a lap joint that maintains an outer surface 42 of the frame 34 is a substantially continuous alignment with an outer surface 44 of the rear body 14. The lap joint may comprise a bonded interface 46 and a mechanical interface 48.

The bonded interface 46 may be formed when a bond surface 50 of the front body 12 (front bond surface 50) abuts and is secured to a mating bond surface 52 of the rear body 14 (rear bond surface 52). In the embodiment shown, the front bond surface 50 surrounds and is radially exterior to the rear bond surface 50, with both surfaces 50, 52 being flush with each other and extending in a generally front/back direction. The front bond surface 50 may be coupled to the rear bond surface 52 through any of the means listed above, however, in a particular embodiment, the two surfaces may each comprise and/or may be formed from a common thermoplastic polymer that may facilitate a material bond or weld to the adjoining surface. Structurally, because the interface between the front and rear bond surfaces 50, 52 is generally parallel to the direction of insertion/extraction of the front body 12 onto the rear body 14, the bond/coupling between surfaces more effectively resist extraction of the front body 12 via sheer engagement of the interface. Specifically, the sheer bond tends to distribute stresses more effectively across the entire bond surface, rather than inducing non-uniform stresses due to, for example, cantilevering.

The mechanical interface may be formed when the rearmost surface 54 of the front body 12 (i.e., the rear end of the frame 34) contacts a mating surface 56 of the rear body 14 that is in line with the outer wall 58 or other structure of the rear body 14. This alignment allows impact loads to be directly transferred from the frame 34 to the rear body 14 and the transition surface 58 via direct contact between the materials, and is not as reliant on the strength of the bond or intermediate adhesive.

In some embodiments, the rear body 14 can further include one or more metallic weight structures to aid in positioning the club head center of gravity low and back. In the embodiment provided in FIGS. 1, 2A, and 2B, the rear body 14 includes as a weight structure 60 that is integral to and encapsulated within the rear body 14 on the sole and back end of the club head 10. In these embodiments, the weight structure 60 can be co-molded with the sole 22 and/or the rear body 14. Further, in these embodiments, the weight structure 60 can comprise a cavity capable of receiving a weight (not shown) that is separately formed and subsequently attached to the weight structure. In other embodiments, not shown, the rear body 14 can include a cavity or void capable of removably receiving a weight that is separately formed and subsequently attached to the cavity.

In some embodiments, the weight structure 60 and/or weight can comprise a mass between 50 grams and 80 grams. Further, the weight structure 60 and/or weight can comprise a metallic material including but not limited to steel, tungsten, aluminum, titanium, bronze, brass, copper, gold, platinum, lead, silver, or zinc. Further, in these embodiments, the weight structure 60 and/or weight can comprise a specific gravity between 2.5 and 18.

As further illustrated in FIG. 1, in some embodiments, the front body 12 may further include a hosel bushing 62 that may operatively receive a portion of a golf shaft or shaft adapter. In one embodiment, the hosel bushing 62 may be formed from a metallic material, such as aluminum. Furthermore, it may be positioned within the hosel 38 and front body 12, for example, by being adhered into place or by being over-molded, such as through an insert molding process. In some embodiments, the hosel bushing 62 or other metallic components on the club head can comprise an anodized outer layer or can comprise a galvanic corrosion barrier to prevent galvanic corrosion.

Polymeric Face Constructions

Figure 3:
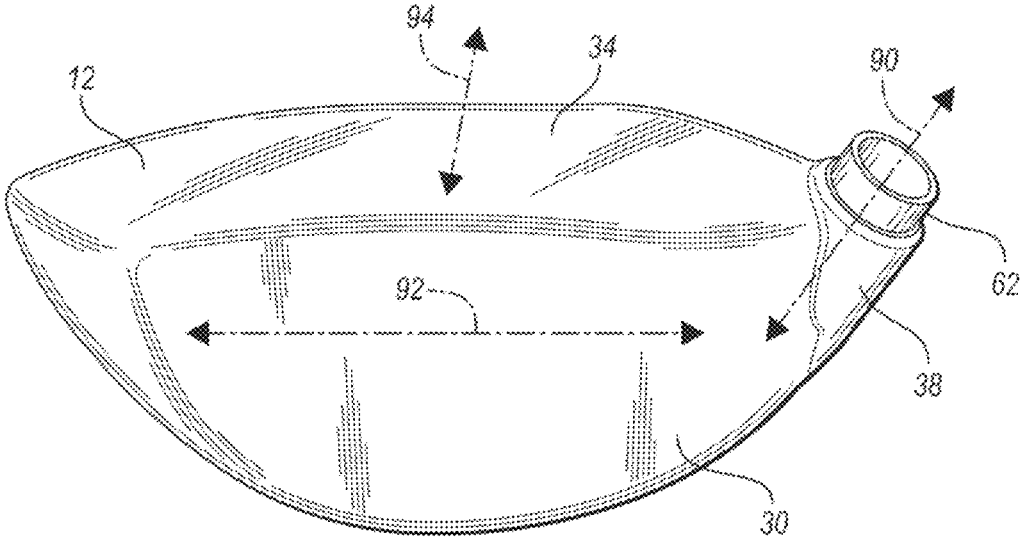
FIG. 3 is a schematic perspective view of the front and top portions of a golf club head.

FIG. 3 schematically illustrates an embodiment of a front body 12 that comprises a molded, fiber-filled thermoplastic composite. Such a composite material comprises both a thermoplastic resin and a plurality of distributed discontinuous fibers (i.e., "chopped fibers"). The discontinuous/chopped fibers may include, for example, chopped carbon fibers or chopped glass fibers that are embedded within the resin prior to molding the front body 12. While possible material configurations will be discussed further below, in one configuration, the polymeric material may be a "long fiber thermoplastic" where the discontinuous fibers are embedded in a thermoplastic resin and each have a designed fiber length of from about 3 mm to about 12 mm. In another configuration, the polymeric material may be a "short fiber thermoplastic" where the discontinuous fibers are similarly embedded in a thermoplastic resin, though may each have a designed length of from about 0.01 mm to about 3 mm. In either case, it should be noted that those lengths are the pre-mixed lengths, and due to breakage during the molding process, some fibers may actually be shorter than the described range in the final component. In some configurations, the discontinuous chopped fibers may be characterized by an aspect ratio (e.g., length/diameter of the fiber) of greater than about 10, or more preferably greater than about 50, and less than about 1500. Regardless of the specific type of discontinuous chopped fibers used, in certain configurations, the material may have a fiber length of from about 0.01 mm to about 12 mm and a resin content of from about 40% to about 90% by weight, or more preferably from about 55% to about 70% by weight.

One suitable thermoplastic resin may include a thermoplastic polyamide (e.g., PA6 or PA66), and it may be filled with chopped carbon fiber (i.e., a carbon-filled polyamide). Other resins may include certain polyimides, polyamide-imides, polyphenylene sulfides (PPS), polyetheretherketones (PEEK), polycarbonates, engineering polyurethanes, and/or other similar materials.

While the use of polymer composites within a club head 10 can result in an overall (structural) weight savings, their use in high stress areas of the club head 10 is complicated by their comparatively lower strength than typical metals and their highly anisotropic nature. This anisotropic nature is demonstrated by a considerably greater tensile strength of the composite when measured along an average longitudinal fiber direction than when measured perpendicular to this average fiber direction. These differences are more evident as the embedded fibers become more uniformly oriented. Depending on the design and materials chosen, certain composites may possess sufficient strength to withstand repeated ball strikes only if the embedded fibers are properly oriented.

Figure 4:
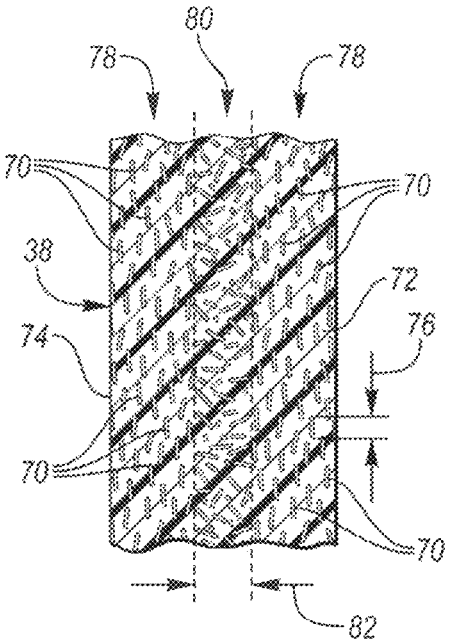
FIG. 4 is a schematic partial cross-sectional view of a polymeric wall with a plurality of discontinuous fibers embedded within the polymer.

One attribute of injection molded fiber-filled polymers is that fiber orientation tends to follow the flow of polymer/flow front within the mold during creation. FIG. 4 schematically illustrates a plurality of chopped fibers 70 embedded within a polymer resin 72, such as in a wall of the hosel 38. As shown, each fiber 70 may have a length 76 that is from about 0.01 mm to about 12 mm (note that the illustrated fibers are not necessarily illustrated to scale in either size or density). During a molding process, such as injection molding, embedded fibers 70 tend to align with a direction of the flowing polymer. With some fibers (i.e., particularly with short fiber reinforced thermoplastics) and resins, the alignment tends to occur more completely close to the walls of the mold or edge of the part. These layers are referred to as shear layers 78 or skin layers. Conversely, within a central core layer 80, the fibers 70 can sometimes be more randomized and/or perpendicular to the flowing polymer. In these embodiments, the thickness 82 of the core layer 80 can be altered by various molding parameters including molding speed (i.e., slower molding speed can yield a thinner core layer 80) and mold design. With the present design, it is desirable to minimize the thickness 82 of any randomized core layer 80 to enable better control over fiber orientation.

Because the strike face 30, frame 34, and hosel 38 are generally the highest-stress portions of the club head 10, particular attention must be paid to the design if attempting to use filled polymer composites in the front body 12. Poorly oriented fiber content may result in a strike face 30 that lacks sufficient structure to withstand repeated impact forces. During an impact, stresses tend to radiate outward from the impact location while propagating toward the rear of the club head 10. Additionally, bending moments are imparted about the shaft, which induces material stresses between the impact location and the hosel 38, and along the hosel 38/parallel to a hosel axis 90. Therefore, in an ideal design, it is preferable for the embedded fibers to generally follow these same directions; namely: within the hosel 38 parallel to the hosel axis 90; across at least the center of the face 30 (represented by the horizontal face axis 92); and, generally outward from the face center with the fibers turning largely rearward within the frame 34 (i.e., parallel to a fore-rear axis 94).

Because the discontinuous fibers are mixed within the flowable polymer prior to forming the part, it is impossible to guarantee perfect alignment. With that said, however, the design of the front body 12 and manner of injection molding (e.g., fill rate, gating/venting, and temperature) may be controlled to align as many of the embedded fibers with these axes as possible. For example, within the hosel, it is preferable if greater than about 50% of the fibers are aligned within 30 degrees of the hosel axis 90. Between the center of the face and the hosel 38, it is preferable if greater than about 50% of the fibers are aligned within 30 degrees of the horizontal face axis 92, and within the frame 34, it is preferable if greater than about 50% of the fibers are aligned within 30 degrees of the fore-rear axis 94. In another embodiment, greater than about 60% of the fibers within the hosel 38 are aligned within 25 degrees of the hosel axis 90, greater than about 60% of the fibers between the center of the face and the hosel 38 are aligned within 25 degrees of the horizontal face axis 92, and greater than about 60% of the fibers within the frame 34 are aligned within 25 degrees of the fore-rear axis 94. In still another embodiment, greater than about 70% of the fibers within the hosel 38 are aligned within 20 degrees of the hosel axis 90, greater than about 70% of the fibers between the center of the face and the hosel 38 are aligned within 20 degrees of the horizontal face axis 92, and greater than about 70% of the fibers within the frame 34 are aligned within 20 degrees of the fore-rear axis 94.

Figure 5:
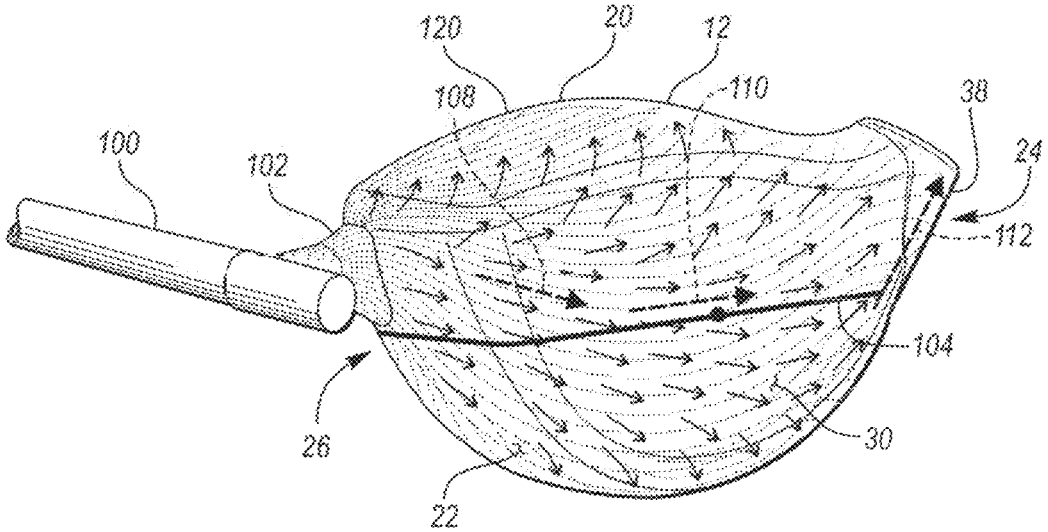
FIG. 5 is a schematic perspective view of a molded front body of a golf club head with a sprue and molding gate leading into the front body.
Figure 6:
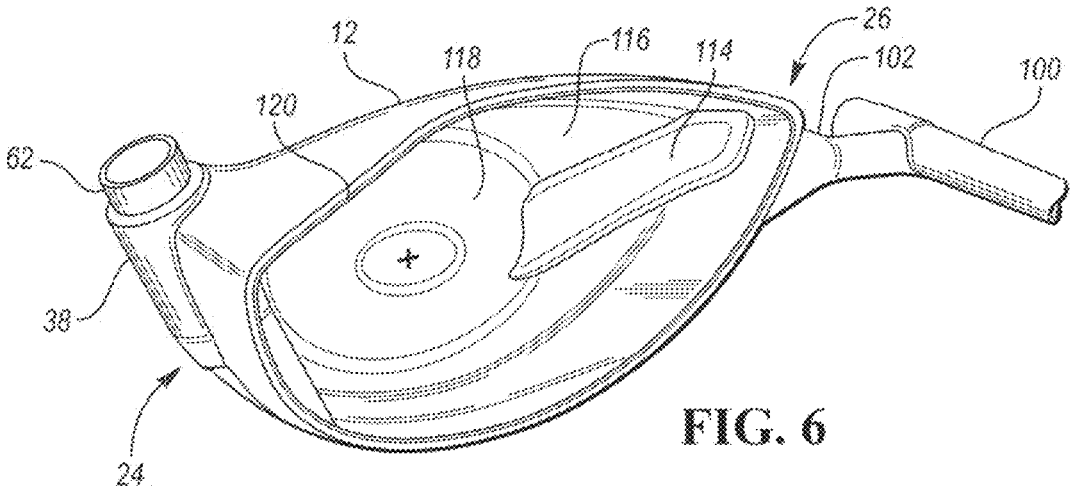
FIG. 6 is a reverse view of the front body of FIG. 5
Figure 8:
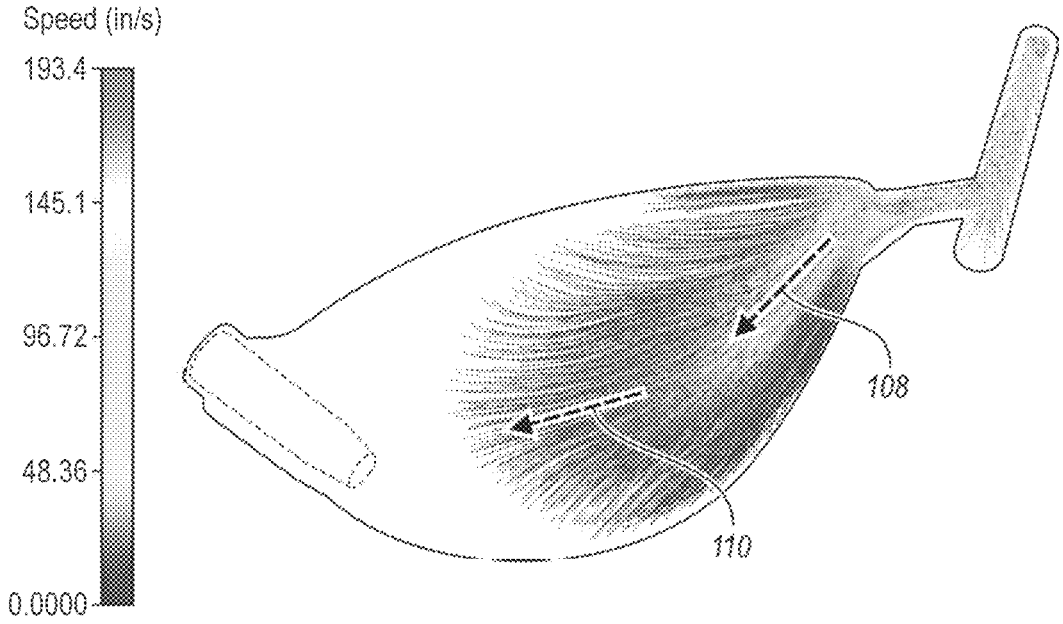
FIG. 8 is a schematic illustration of the mold flow for creating the front body of FIG. 5, taken at a point of intermediate fill.
Figure 9:
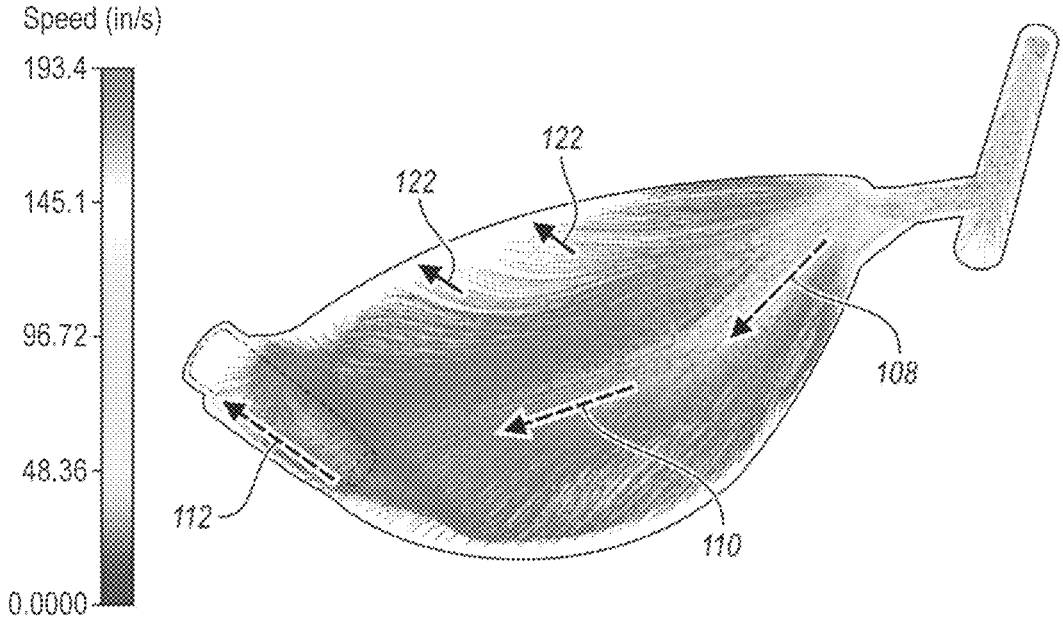
FIG. 9 is a schematic illustration of the mold flow of FIG. 8, taken at a point nearing complete creation of the part.

FIGS. 5-6 illustrate a front body design that generally accomplishes the fiber alignment described above. The flow and fiber alignment is schematically illustrated in FIG. 5, and with additional clarity via the mold flow simulation outputs as can be seen in the illustrations in FIGS. 8-9. As shown through these figures, flowable polymer passes from a sprue 100 and connected gate 102 directly into the toe portion 26 of the front body 12, such as illustrated in FIG. 5. From there, the polymer may flow across the face 30, and then upward through the hosel 38. By flowing across the face 30 and upward through the hosel 38, any weld lines are pushed high and to the heel side of the hosel 38, which is generally the lowest stress area of the hosel 38. If the body 12 were attempted to be gated at the hosel 38, there would more likely be a weld line in or near the face 30, or on the toe side of the hosel 38, which experiences comparatively greater stress than the heel side. Because weld lines have a lower ultimate strength than the typical polymer, it is important to ensure that they do not get formed in areas that typically experience higher stresses.

To encourage the polymer to fill the hosel 38 from bottom to top, it may be desirable to fill the face from a location near the toe 26 and that is at or preferably above the horizontal centerline 104 of the face 30 (i.e., between the crown 20 and a line drawn through the center of the face 106 and parallel to a ground plane when the club is held at address). This may encourage the flow 108 and corresponding fiber alignment to follow a generally downward slant from above the horizontal centerline 104 at the toe 26 toward the center of the face 106 while between the toe and the center 106. Following this, at the center 106, the flow 110 and corresponding fiber alignment may generally be parallel to the horizontal centerline 104 at or immediately surrounding the center of the face 106. Finally, the flow 112 may arc upward and fill the hosel 38 largely from the bottom toward the neck. The general directional references illustrated at 108, 110, and 112 are generally intended to indicate that greater than about 50% of the fibers within the polymer are aligned within about 30 degrees of the indicated direction, or more preferably that more than about 60% of the fibers are aligned within about 25 degrees of the indicated direction, or even more preferably that more than about 70% of the fibers are aligned within about 20 degrees of the indicated direction.

Figure 7:
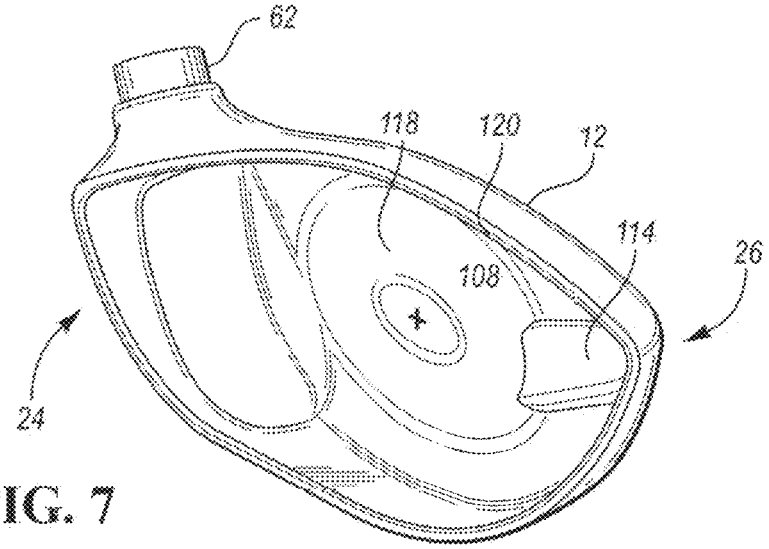
FIG. 7 is a schematic perspective view of the rear portion of a molded front body of a golf club head.

As shown in FIG. 5, in one embodiment, the gate 102 may be a fan gate that is located in a rear half of the frame 34 immediately below the crown 20. To promote the directional flow 108, 110 across the face 30 while also encouraging a slight downward arc at 108, a flow leader 114 may protrude from a rear surface 116 of the strike face 30, such as shown in FIGS. 6-7. As shown, the flow leader 114 is an embossed channel that extends from an edge of the face 30 at or near the gate and propagates away from the gate, inward toward a central region of the face 30 to direct the flow of material. It may serve as a path of comparatively lower resistance for material to flow, thus ensuring a primary flow-direction. In some embodiments, the flow leader 114 may be raised above the surrounding surface 116 by a height of from about 0.5 mm to about 1.5 mm, or from about 0.7 mm to about 1.0 mm. Furthermore, the flow leader 114 may have a lateral width, measured orthogonally to the height and to a line from the origin of the flow leader at the toe 26 to the face center 106, of from about 5 mm to about 15 mm, or from about 7 mm to about 12 mm.

As further shown in FIGS. 6-7, in one embodiment, the flow leader 114 may lead into a thickened central region 118 of the face 30. This thickened central portion 118 may primarily be used to stiffen the central region of the face against impacts so that the face moves more as a single unit while avoiding local deformations. From a molding perspective, this thickened region 118 may serve as a well or manifold of sorts that may supply polymer radially outward to fill the frame from front to back (or at least to steer polymer flowing through the thinner areas toward the rear edge 120 of the frame). The flow convergence from the thicker region 118 to the surrounding thinner areas will also aid aligning the embedded fibers.

As noted above, FIGS. 8-9 illustrate two molding simulation outputs that depict the front body 12 at different stages of fill/molding. As shown, the primary flow path originates from the upper toe portion 26 and then is directed downward (at 108) via the flow leader 114 to the thickened center region 118, after which it crosses the face (at 110) and generally turns back upward (at 112) when filling the hosel 38 from bottom to top. While the primary flow is down and across the face 30, it can also be seen that polymer turns rearward (at 122) from this primary flow path into the frame 34, which is consistent with the flow convergence from the flow leader and thickened center region into the comparatively thinner periphery and frame regions.

In many embodiments, the face thickness may vary such that the minimum face thickness ranges from 0.114 inch and 0.179 inch, and the maximum face thickness ranges from 0.160 inch to 0.301 inch. The minimum face thicknesses can be 0.110 inches, 0.114 inches, 0.115 inches, 0.120 inches, 0.125 inches, 0.130 inches, 0.135 inches, 0.140 inches, 0.145 inches, 0.150 inches, 0.155 inches, 0.160 inches, 0.165 inches, 0.170 inches, 0.175 inches, 0.179 inches, or 0.180 inches. The maximum face thickness can be 0.160 inches, 0.165 inches, 0.170 inches, 0.175 inches, 0.180 inches, 0.185 inches, 0.190 inches, 0.195 inches, 0.200 inches, 0.205 inches, 0.210 inches, 0.215 inches, 0.220 inches, 0.225 inches, 0.230 inches, 0.235 inches, 0.240 inches, 0.245 inches, 0.250 inches, 0.255 inches, 0.260 inches, 0.265 inches, 0.270 inches, 0.275 inches, 0.280 inches, 0.285 inches, 0.290 inches, 0.300 inches, 0.301 inches, 0.305 inches, or 0.310 inches.

Figure 10:
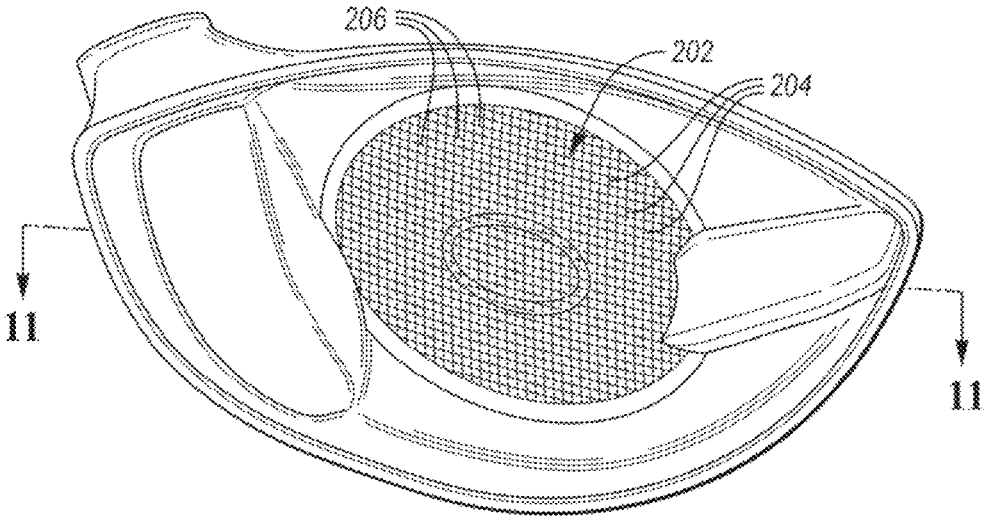
FIG. 10 is a schematic perspective view of the rear portion of a molded front body of a golf club head with a reinforcing mesh embedded within the strike face.

FIG. 10 schematically illustrates an embodiment of a thermoplastic composite front body 200 that includes an embedded reinforcing elements 202 that extend across at least a portion of the strike face 30. In one configuration, the illustrated embodiment may be formed via an insert injection molding process, whereby the reinforcing elements 202 are placed within the mold prior to the flowable polymer being injected.

The reinforcing elements 202 may comprise a plurality of continuous fibers, wires, or other elongate elements that extend across a substantial portion of the face (i.e., more than about 25 mm, or more than about 30 mm, or more than about 35 mm, or more than about 40 mm). In some embodiments, these elements 202 may include a first plurality of elements 204 that extend generally parallel to each other in a first spaced arrangement. Furthermore, in some embodiments, the reinforcing elements 202 may include a second plurality of elements 206 that extend generally parallel to each other in a second spaced arrangement, where the first and second plurality of elements 204, 206 are not parallel. As shown in FIG. 10, in one configuration, the first and second plurality of elements 204, 206 may form an orthogonal mesh or grid. In some embodiments, the grid may be unitary, such that the first and second plurality of elements 204, 206 are integral to each other. In other embodiments, they may be woven in an alternating pattern.

To ensure that the reinforcing elements 202 are adequately embedded within the composite and that they do not simply create a weakened internal boundary plane, it may be necessary to ensure a minimum spacing between adjacent elements. For example, as generally illustrated in the cross-sectional view provided in FIG. 11, each element may generally have a diameter 208, and adjacent elements may be spaced by a separation distance 210. In one configuration, the minimum spacing is such that the separation distance 210 is greater than or equal to the average diameter 208 of the adjacent elements. In other embodiments, the separation distance 210 may be more than two times the average diameter 208 of the adjacent elements, or more than three times the average diameter 208 of the adjacent elements, or four times the average diameter 208 of the adjacent elements. In fact, the greater the spacing, the more completely the elements 202 will be integrated within the molded polymer. In one example, the average diameter may be from about 0.05 mm to about 1.5 mm, or from about 0.1 mm to about 1.0 mm.

The continuous reinforcing elements 202 may be formed from any high strength material including carbon fiber, glass fiber, aramid fiber, or the like. In some embodiments, however, the reinforcing elements 202 may be formed from metal, with each reinforcing element being a wire or plurality of bundled wires. In one configuration, the metal may be a metal that is traditionally used to form golf club faces such as, for example, a stainless steel or steel alloy (e.g., C300, C350, Ni (Nickel)-Co(Cobalt)-Cr(Chromium)-Steel Alloy, 565 Steel, AISI type 304 or AISI type 630 stainless steel), a titanium alloy (e.g., a Ti-6-4, Ti-3-8-6-4-4, Ti-10-2-3, Ti 15-3-3-3, Ti 15-5-3, Ti185, Ti 6-6-2, Ti-7s, Ti-92, or Ti-8-1-1 Titanium alloy), or other similar materials.

Figure 11:
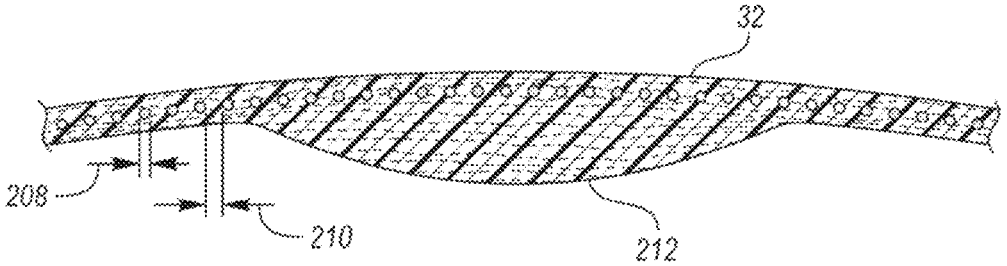
FIG. 11 is a schematic cross-sectional view of a first embodiment of the golf club head of FIG. 10, taken along line 11-11.
Figure 12:
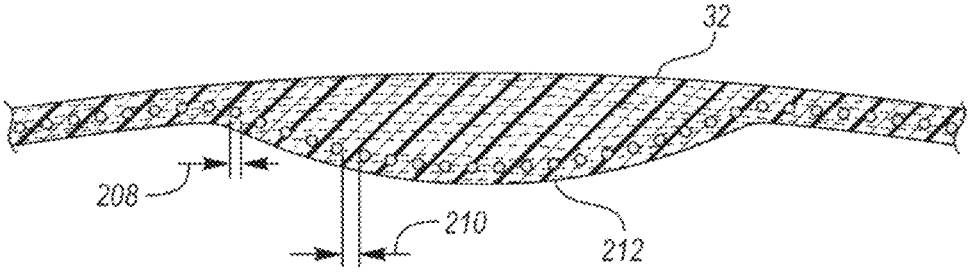
FIG. 12 is a schematic cross-sectional view of a second embodiment of the golf club head of FIG. 10, taken along line 11-11.
Figure 13:
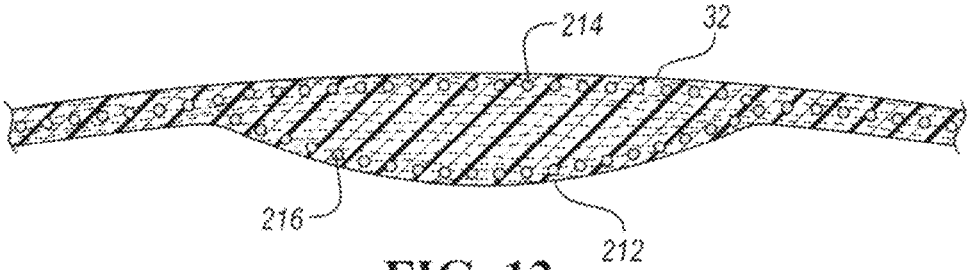
FIG. 13 is a schematic cross-sectional view of a third embodiment of the golf club head of FIG. 10, taken along line 11-11.

In one configuration, such as shown in FIG. 11, the reinforcing elements 202 may generally be aligned with and parallel to the ball striking surface 32. Such an embodiment may serve to reinforce the polymer and polymer integrity against impacts. In another configuration, however, such as shown in FIG. 12, the reinforcing elements 202 may generally be aligned with and parallel to the rear surface 212 of the face 30. Such an embodiment may provide greater resilience against bending and face deflection, which may lower the characteristic time of the face (which is measured according to USGA guidelines). In still a third configuration, such as shown in FIG. 13, a first plurality of reinforcing elements 214 may be parallel to the ball striking surface 32 and a second plurality of reinforcing elements 216 may be parallel to the rear surface 212. Such an embodiment may provide a combination of the benefits described with respect to FIGS. 11 and 12.

Thermoplastic Composite Materials

As mentioned above, the molded front body 12 may be formed from a thermoplastic composite material that comprises a thermoplastic polymer matrix material and a filler. Exemplary thermoplastic polymer matrix materials include polycarbonate (PC), polyester (PBT), polyphenylene sulfide (PPS), polyamide (PA) (e.g. polyamide 6 (PA6), polyamide 6-6 (PA66), polyamide-12 (PA12), polyamide-612 (PA612), polyamide 11 (PA11)), thermoplastic polyurethane (TPU), polyphthalamide (PPA), acrylonitrile butadiene styrene (ABS), polybutylene terephthalate (PBT), polyvinylidene fluoride (PVDF), polyethylene (PE), polyphenylene ether/oxide (PPE), polyoxymethylene (POM), polypropylene (PP), styrene acrylonitrile (SAN), polymethylpentene (PMP), polyethylene terephthalate (PET), acrylonitrile styrene acrylate (ASA), polyetherimide (PEI), polyvinylidene fluoride (PVDF), polymethylmethacrylate (PMMA), polyether ether ketone (PEEK), polyether ketone (PEK), polyetherimide (PEI), polyethersulfone (PES), polyphenylene oxide (PPO), polystyrene (PS), polysulfone (PSU), polyvinyl chloride (PVC), liquid crystal polymer (LCP), thermoplastic elastomer (TPE), ultra-high molecular weight polyethylene (UHMWPE), or alloys of the above described thermoplastic materials, such as an alloy of acrylonitrile butadiene styrene (ABS) and polycarbonate (PC) or an alloy of acrylonitrile butadiene styrene (ABS) and polyamide (PA).

For example, in some embodiments, the thermoplastic composite material can include thermoplastic polyurethane (TPU) as the thermoplastic polymer matrix material. TPU comprises a chemical structure consisting of linear segmented block copolymers having hard and soft segments. In some embodiments, the hard segments comprise aromatic or aliphatic structures, and the soft segments comprise polyether or polyester chains. In other embodiments, the thermoplastic polymer matrix material comprising TPU can have a hard and soft segments with different chemical structures.

For further example, in some embodiments, the thermoplastic composite material can include polyamine 6-6 (PA66) or polyamide 6 (PA6) as the thermoplastic polymer matrix material. FIG. 10 illustrates the chemical structure of polyamide 6-6 (PA6-6). PA66 is a type of polyamide made of two monomers, including hexamethylenediamine and adipic acid, each containing 6 carbon atoms. FIG. 11 illustrates the chemical structure of polyamide 6 (PA6), a semicrystalline polyamide.

The fillers of the thermoplastic composite material can include fibers, beads, or other structures comprising various materials (described below) that are mixed with the thermoplastic polymer. The fillers can provide structural reinforcement, weighting, lightening, or various other characteristics to the thermoplastic composite material. In many embodiments, the fillers can comprise carbon or glass. However, in other embodiments, the fillers can comprise other suitable materials. For example, the fillers of one or more lamina layer can comprise aramid fibers (e.g. Nomex, Vectran, Kevlar, Twaron), bamboo fibers, natural fibers (e.g. cotton, hemp, flax), metal fibers (e.g. titanium, aluminum), glass beads, tungsten beads, or ceramic fibers (e.g. titanium dioxide, granite, silicon carbide).

The fillers or fibers can be short (less than approximately 0.5 mm in length or diameter), long (ranging in length or diameter between approximately 0.5 mm to approximately 40 mm, or more preferably between approximately 5 mm and approximately 12 mm), or continuous (greater than approximately 40 mm in length). In many embodiments, the front body 12 and the rear body 14 comprise short and/or long fibers. In other embodiments, the front body 12 and the rear body 14 can comprise continuous fibers instead of, or in addition to the short and long fibers.

In many embodiments, the thermoplastic composite material can comprise 30-40% fillers by volume. In other embodiments, the thermoplastic composite material can comprise up to 55%, up to 60%, up to 65%, or up to 70% fillers by volume.

In many embodiments, the thermoplastic composite comprises a specific gravity of approximately 1.0-2.0, which is significantly lower than the specific gravity of metallic materials used in golf (e.g. the specific gravity of titanium is approximately 4.5 and the specific gravity of aluminum is approximately 3.5). Further, in many embodiments, the thermoplastic composite material comprises a strength to weight ratio or specific strength greater than 1,000,000 PSI/(lb/in3), and a strength to modulus ratio or specific flexibility greater than 0.009. The specific gravity, specific strength, and specific flexibility of the thermoplastic composite material enable significant weight savings in the club head 10, while maintaining durability.

Methods of Forming Golf Club Heads Having Thermoplastic Composite Materials

In the illustrated embodiment of FIGS. 1-3, the club head comprises (1) a front body 12 having a strike face 30 and a frame 34 that surrounds and extends rearward from the strike face 30 and a return portion, and (2) a rear body 14 comprising a crown portion 20 and a sole portion 22. In these or other embodiments, the front body 12 and the rear body 14 can be formed separately and subsequently joined to form the club head 10. The method of forming the club head 10 comprises the following steps, described in further detail below: (1) forming the front body 12, (2) forming the crown portion 20 and the sole portion 22, (3) coupling the crown portion 20 and the sole portion 22 to form the rear body 14, (4) coupling the front body 12 and the rear body 14 via the joint 40 to form the club head 10, wherein the crown portion 20 and the sole portion 22 and/or the front body 12 and the rear body 14 are coupled by fusion bonding. In this or other embodiments, fusion bonding can include, but is not limited to thermal welding (e.g. hot tool welding, hot gas welding, extrusion welding, infrared welding, laser welding), friction welding (e.g. spin welding, vibration welding, ultrasonic welding, stir welding) and electromagnetic welding (e.g. induction welding, dielectric welding, microwave welding, resistance welding).

As discussed above, the front body 12 may be formed, for example, using an injection molding process. In such a process, a flowable thermoplastic polymer is injected into a cavity of a mold, where the cavity is the negative of the part to-be-formed. Prior to injecting the flowable polymer, a plurality of discontinuous fibers are mixed into the polymer such that they are generally dispersed in a consistent manner. The flowable polymer is then injected into the mold, where it fills the cavity and solidifies.

In an embodiment such as shown in FIGS. 10-13, the reinforcing elements 202 may first be formed or otherwise provided into a substantially final form. This may happen by first providing a substantially uniform planar mesh or grid, and then either compression molding or stamping the mesh/grid into a desired final shape. Once the mesh is in a completed shape, it may then be inserted into the mold prior to injecting the flowable polymer. During the injecting process, the flowable polymer will surround the formed mesh and fill the interstitial spaces.

In some embodiments, the rear body 14 may be formed from one or more thermoplastic composite materials to facilitate the fusion bond with the front body 12 (i.e., via the joint 40 described above). In one configuration, the rear body 14 may be constructed from injection molded and compression molded thermoplastic composites, such as described in U.S. Pat. No. 9,925,432, which is incorporated by reference in its entirety. By incorporating a common, or otherwise miscible thermoplastic polymer in both the rear body 14 and front body 12, the fusion joint may be made feasible and more robust.

Advantages of Club Heads Comprising Thermoplastic Composite Materials

The thermoplastic composite material enables heating and reforming (due to the thermoplastic matrix material). Accordingly, an entire hollow body club head can be molded in pieces and then fused together without the need for intermediate adhesives. This is generally contrary to many current club heads that have structural metal frames and composite panel inserts (comprising thermoset matrices, which cannot be reformed upon heating).

Further, the thermoplastic composite material reduces the structural mass of the club head beyond what is possible with traditional metal and composite forming techniques used in golf club heads. The structural weight savings accomplished through this design may be used to either reduce the entire weight of the club head 10 (which may provide faster club head speeds and/or longer hitting distances) or to increase the amount of discretionary mass that is available for placement on the club head (i.e., for a constant club head weight). In a preferred embodiment, the additional discretionary mass is incorporated in the final club head design via one or more metallic weights 60 that are coupled with the sole 22 and/or rear-most portion of the club head 10.

The thermoplastic composite material provides the structural integrity necessary to withstand impact forces, while saving weight as described above. In many embodiments, the fiber reinforced thermoplastic composite can comprise a strength to weight ratio and a strength to modulus ratio (as described above) greater than ratios achievable with metallic materials.

Example 1: Face Comprising TPU Thermoplastic Composite Material

According to one example, a golf club head has a strike face 30 comprising a thermoplastic composite material. The thermoplastic composite material comprises TPU as a thermoplastic polymer matrix material, with 40% fill of long carbon fibers. The strike face 30 comprises a thickness of 0.265 inch, resulting in an average coefficient of restitution (COR) between 0.821 and 0.826. As a comparative, a similar strike face comprising a titanium alloy resulted in a coefficient of restitution of approximately 0.828. Accordingly, the coefficient of restitution of the exemplary strike face 30 comprising TPU with 40% fill of long carbon fibers, and having a thickness of 0.265 inch, maintained a similar coefficient of restitution (within 0.85%) compared to a similar strike face comprising a titanium alloy. Further, the exemplary strike face 30 maintained durability during testing. The results described herein were obtained by testing COR plates per USGA methods.

Example 2: Face Comprising TPU Thermoplastic Composite Material

According to another example, a golf club head has a strike face 30 comprising a thermoplastic composite material. The thermoplastic composite material comprises TPU as a thermoplastic polymer matrix material, with 50% fill of long carbon fibers. The strike face 30 comprises a thickness of 0.265 inch, resulting in an average coefficient of restitution (COR) of 0.815. As a comparative, a similar strike face comprising a titanium alloy resulted in a coefficient of restitution of approximately 0.828. Accordingly, the coefficient of restitution of the exemplary strike face 30 comprising TPU with 50% fill of long carbon fibers, and having a thickness of 0.265 inch, maintained a similar coefficient of restitution (within 1.6%) compared to a similar strike face comprising a titanium alloy. Further, the exemplary strike face 30 maintained durability during testing. The results described herein were obtained by testing COR plates per USGA methods.

Example 3: Face Comprising PA6 Thermoplastic Composite Material

According to one example, a golf club head has a strike face 30 comprising a thermoplastic composite material. The thermoplastic composite material comprises TPU as a thermoplastic polymer matrix material, with 50% fill of long carbon fibers. The strike face 30 comprises a thickness of 0.275 inch, resulting in an average coefficient of restitution (COR) of 0.814. As a comparative, a similar strike face comprising a titanium alloy resulted in a coefficient of restitution of approximately 0.828. Accordingly, the coefficient of restitution of the exemplary strike face 30 comprising TPU with 50% fill of long carbon fibers, and having a thickness of 0.275 inch, maintained a similar coefficient of restitution (within 1.7%) compared to a similar strike face comprising a titanium alloy. Further, the exemplary strike face 30 maintained durability during testing. The results described herein were obtained by testing COR plates per USGA methods.

Example 4: Face Comprising PA6 Thermoplastic Composite Material

According to one example, a golf club head has a strike face 30 comprising a thermoplastic composite material. The thermoplastic composite material comprises TPU as a thermoplastic polymer matrix material, with 40% fill of long carbon fibers. The strike face 30 comprises a thickness of 0.266 inch, resulting in an average coefficient of restitution (COR) of 0.808. As a comparative, a similar strike face comprising a titanium alloy resulted in a coefficient of restitution of approximately 0.828. Accordingly, the coefficient of restitution of the exemplary strike face 30 comprising TPU with 40% fill of long carbon fibers, and having a thickness of 0.266 inch, maintained a similar coefficient of restitution (within 2.4%) compared to a similar strike face comprising a titanium alloy. Further, the exemplary strike face 30 maintained durability during testing. The results described herein were obtained by testing COR plates per USGA methods.

Example 5: Face Comprising PA6 Thermoplastic Composite Material

According to one example, a golf club head has a strike face 30 comprising a thermoplastic composite material. The thermoplastic composite material comprises TPU as a thermoplastic polymer matrix material, with 50% fill of long carbon fibers. The strike face 30 comprises a thickness of 0.272 inch, resulting in an average coefficient of restitution (COR) of 0.802. As a comparative, a similar strike face comprising a titanium alloy resulted in a coefficient of restitution of approximately 0.828. Accordingly, the coefficient of restitution of the exemplary strike face 30 comprising TPU with 50% fill of long carbon fibers, and having a thickness of 0.272 inch, maintained a similar coefficient of restitution (within 3.1%) compared to a similar strike face comprising a titanium alloy. Further, the exemplary strike face 30 maintained durability during testing. The results described herein were obtained by testing COR plates per USGA methods.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a driver-type golf club, the apparatus, methods, and articles of manufacture described herein may be applicable to other types of golf club such as a fairway wood-type golf club, a hybrid-type golf club, an iron-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Various features and advantages of the disclosure are set forth in the following clauses:

Clause 1: A golf club head comprising: a front body including a strike face defining a ball striking surface, a hosel, and a frame that at least partially surrounds the strikeface and extends rearward from a perimeter of the strikeface away from the ball striking surface; a rear body coupled to the front body to define a hollow cavity therebetween; and wherein: the strike face and frame are formed from a thermoplastic composite comprising a thermoplastic polymer having a plurality of discontinuous fibers embedded therein; each of the plurality of discontinuous fibers have a length of less than about 40 mm; and between a center of the strike face and the hosel, greater than about 50% of the plurality of discontinuous fibers are aligned within about 30 degrees of parallel to a horizontal axis extending from the center of the strike face to the hosel.

Clause 2: The golf club head of clause 1, wherein the front body comprises a rear edge that abuts the rear body when the rear body is coupled to the front body; and wherein within the frame, greater than about 50% of the plurality of discontinuous fibers are aligned within about 30 degrees of parallel to an axis extending from the ball striking surface to the rear edge and perpendicular to the horizontal axis.

Clause 3: The golf club head of clause 2, wherein the axis extending from the ball striking surface to the rear edge is perpendicular to the rear edge.

Clause 4: The golf club head of any of clauses 1-3, wherein the front body includes: a toe portion on an opposite side of the strike face from the hosel; the frame defining a portion of a crown and a sole; the horizontal axis extending between the crown and the sole and through the center of the strike face; a rear surface on an opposite side of the strike face from the ball striking surface; and wherein the strike face includes a flow leader protruding from the rear surface away from the ball striking surface, the flow leader extending from the toe portion between the crown and the horizontal axis toward the center of the strike face.

Clause 5: The golf club head of clause 4, further comprising a thickened center region protruding from the rear face surface away from the ball striking surface and centered about the center of the strike face.

Clause 6: The golf club head of any of clauses 1-5, wherein the thermoplastic composite is a polyamide and each of the plurality of discontinuous fibers are carbon fibers.

Clause 7: The golf club head of any of clauses 1-6, further comprising a plurality of continuous reinforcing elements embedded within the thermoplastic polymer of the strike face.

Clause 8: The golf club head of clause 7, wherein the plurality of continuous reinforcing elements comprise an orthogonal mesh.

Clause 9: The golf club head of any of clauses 7-8, wherein the plurality of reinforcing elements comprise metallic wires.

Clause 10: The golf club head of any of clauses 7-9, wherein each of the plurality of reinforcing elements have a diameter and at least a first subset of the plurality of reinforcing elements are arranged in a parallel arrangement; wherein adjacent reinforcing elements of the first subset of the plurality of reinforcing elements are spaced apart from each other by a minimum distance; and wherein the minimum distance is at least two times an average diameter of the first subset of reinforcing elements.

Clause 11: A polymeric front body of a golf club head comprising: a strike face defining a ball striking surface, the strike face having a geometric center and defining a horizontal axis extending through the geometric center; a frame that at least partially surrounds the strikeface and extends rearward from a perimeter of the strikeface away from the ball striking surface, the frame defining a crown portion and a sole portion; a hosel, wherein the horizontal axis extends between the geometric center and the hosel and between the crown and at least a portion of the sole; a fan gate extending from the frame between the horizontal axis and the crown.

Clause 12: The polymeric front body of clause 11, wherein the strike face further defines a rear surface opposite the ball striking surface, the front body further comprising: a flow leader protruding from the rear surface away from the ball striking surface, the flow leader extending from a portion of the strike face nearest to the fan gate toward the center of the strike face.

Clause 13: The polymeric front body of clause 12, further comprising a thickened center region protruding from the rear face surface away from the ball striking surface and centered about the geometric center of the strike face.

Clause 14: The polymeric front body of any of clauses 11-13, wherein the strike face and frame comprise a thermoplastic composite comprising a thermoplastic polymer having a plurality of discontinuous fibers embedded therein, each of the plurality of discontinuous fibers have a length of less than about 40 mm.

Clause 15: The polymeric front body of clause 14, wherein between the center of the strike face and the hosel, greater than about 50% of the plurality of discontinuous fibers are aligned within about 30 degrees of parallel to the horizontal axis.

Clause 16: The polymeric front body of any of clauses 14-15, wherein the frame defines a rear edge opposite the strike face, and wherein within the frame, greater than about 50% of the plurality of discontinuous fibers are aligned within about 30 degrees of parallel to an axis extending from the ball striking surface to the rear edge and perpendicular to the horizontal axis.

Clause 17: The polymeric front body of clause 16, wherein the axis extending from the ball striking surface to the rear edge is perpendicular to the rear edge.

Clause 18: The polymeric front body of any of clauses 11-17, further comprising a plurality of reinforcing elements embedded within the strike face.

Clause 19: The polymeric front body of clause 18, wherein the plurality of reinforcing elements comprise an orthogonal mesh.

Clause 20: The polymeric front body of any of clauses 18-19, wherein each of the plurality of reinforcing elements have a diameter and at least a first subset of the plurality of reinforcing elements are arranged in a parallel arrangement; wherein adjacent reinforcing elements of the first subset of the plurality of reinforcing elements are spaced apart from each other by a minimum distance; and wherein the minimum distance is at least two times an average diameter of the first subset of reinforcing elements.

Clause 21: The polymeric front body of any of clauses 18-20, wherein the plurality of reinforcing elements comprise metallic wires.

The invention claimed is:

1. A golf club head comprising:

a front body including a strike face defining a ball striking surface, a hosel, and a frame that at least partially surrounds the strike face and extends rearward from a perimeter of the strike face away from the ball striking surface;

a rear body coupled to the front body to define a hollow cavity therebetween;

wherein the rear body comprises a weight structure; and wherein:

an entirety of the strike face and frame are formed from a thermoplastic composite comprising a thermoplastic polymer having a plurality of discontinuous fibers embedded therein;

between a center of the strike face and the hosel, greater than about 50% of the plurality of discontinuous fibers are aligned within about 30 degrees of parallel to a horizontal axis extending from the center of the strike face to the hosel;

each of the plurality of discontinuous fibers has a length of between about 0.01 mm and 3 mm; and the thermoplastic composite is 30% to 70% fibers by volume.

2. The golf club head of claim 1, wherein:

within the frame, greater than about 50% of the plurality of discontinuous fibers are aligned within about 30 degrees of parallel to an axis extending from the ball striking surface to a rear edge and perpendicular to the horizontal axis; and the axis extending from the ball striking surface to the rear edge is perpendicular to the rear edge.

3. The golf club head of claim 1, wherein the front body includes:

a toe portion on an opposite side of the strike face from the hosel;

the frame defining a portion of a crown and a sole;

a horizontal axis extending between the crown and the sole and through the center of the strike face;

a rear surface on an opposite side of the strike face from the ball striking surface; and wherein the strike face includes an embossed channel protruding from the rear surface away from the ball striking surface, the embossed channel extending from the toe portion between the crown and the horizontal axis toward the center of the strike face.

4. The golf club head of claim 3, further comprising a thickened center region protruding from the rear surface away from the ball striking surface and centered about the center of the strike face.

5. The golf club head of claim 1, wherein the thermoplastic composite comprises a thermoplastic polymer matrix material chosen from a group consisting of polycarbonate (PC), polyester (PBT), polyphenylene sulfide (PPS), polyamide (PA) (e.g. polyamide 6 (PA6), polyamide 6-6 (PA66), polyamide-12 (PA12), polyamide-612 (PA612), 14 polyamide 11 (PAI11)), thermoplastic polyurethane (TPU), polyphthalamide (PPA), acrylonitrile butadiene styrene (ABS), polybutylene terephthalate (PBT), polyvinylidene fluoride (PVDF), polyethylene (PE), polyphenylene ether/oxide (PPE), polyoxymethylene (POM), polypropylene (PP), styrene acrylonitrile (SAN), polymethylpentene (PMP), polyethylene terephthalate (PET), acrylonitrile styrene acrylate (ASA), polyetherimide (PEI), polyvinylidene fluoride (PVDF), polymethylmethacrylate (PMMA), polyether ether ketone (PEEK), polyether ketone (PEK), polyetherimide (PEI), polyethersulfone (PES), polyphenylene oxide (PPO), polystyrene (PS), polysulfone (PSU), polyvinyl chloride (PVC), liquid crystal polymer (LCP), thermoplastic elastomer (TPE), ultra-high molecular weight polyethylene (UHMWPE), and alloys of these materials.

6. The golf club head of claim 1, wherein a material of the plurality of discontinuous fibers is chosen from a group consisting of carbon, glass, aramid, bamboo, cotton, hemp, flax, titanium, aluminum, titanium dioxide, granite, and silicon carbide.

7. The golf club head of claim 1, further comprising a plurality of continuous reinforcing elements embedded within the thermoplastic polymer of the strike face.

8. The golf club head of claim 1, wherein the weight structure is co-molded with the rear body.

9. The golf club head of claim 1, wherein the weight structure comprises a metallic material chosen from the group consisting of steel, tungsten, aluminum, titanium, bronze, brass, copper, gold, platinum, lead, silver, and zinc.

10. The golf club head of claim 1, wherein the weight structure comprises a mass between 50 and 80 grams.

11. A golf club head comprising:

a front body including a strike face defining a ball striking surface, a hosel, and a frame that at least partially surrounds the strike face and extends rearward from a perimeter of the strike face away from the ball striking surface;

a rear body coupled to the front body to define a hollow cavity therebetween;

wherein the rear body comprises a weight structure; and wherein:

an entirety of the strike face and frame are formed from a thermoplastic composite comprising a thermoplastic polymer having a plurality of discontinuous fibers embedded therein;

each of the plurality of discontinuous fibers has a length of between about 0.01 mm and 3 mm;

a plurality of continuous reinforcing elements embedded within the thermoplastic polymer of the strike face;

wherein:

a first set of the plurality of reinforcing elements extend generally parallel to each other.

12. The golf club head of claim 11, wherein:

within the frame, greater than about 50% of the plurality of discontinuous fibers are aligned within about 30 degrees of parallel to an axis extending from the ball striking surface to a rear edge and perpendicular to a horizontal axis; and the axis extending from the ball striking surface to the rear edge is perpendicular to the rear edge.

13. The golf club head of claim 11, wherein the front body includes:

a toe portion on an opposite side of the strike face from the hosel;

the frame defining a portion of a crown and a sole;

a horizontal axis extending between the crown and the sole and through a center of the strike face;

a rear surface on an opposite side of the strike face from the ball striking surface; and wherein the strike face includes an embossed channel protruding from the rear surface away from the ball striking surface, the embossed channel extending from the toe portion between the crown and the horizontal axis toward the center of the strike face.

14. The golf club head of claim 11, wherein the thermoplastic composite comprises a thermoplastic polymer matrix material chosen from a group consisting of polycarbonate (PC), polyester (PBT), polyphenylene sulfide (PPS), polyamide (PA) (e.g. polyamide 6 (PA6), polyamide 6-6 (PA66), polyamide-12 (PA12), polyamide-612 (PA612), 14 polyamide 11 (PAI11)), thermoplastic polyurethane (TPU), polyphthalamide (PPA), acrylonitrile butadiene styrene (ABS), polybutylene terephthalate (PBT), polyvinylidene fluoride (PVDF), polyethylene (PE), polyphenylene ether/oxide (PPE), polyoxymethylene (POM), polypropylene (PP), styrene acrylonitrile (SAN), polymethylpentene (PMP), polyethylene terephthalate (PET), acrylonitrile styrene acrylate (ASA), polyetherimide (PEI), polyvinylidene fluoride (PVDF), polymethylmethacrylate (PMMA), polyether ether ketone (PEEK), polyether ketone (PEK), polyetherimide (PEI), polyethersulfone (PES), polyphenylene oxide (PPO), polystyrene (PS), polysulfone (PSU), polyvinyl chloride (PVC), liquid crystal polymer (LCP), thermoplastic elastomer (TPE), ultra-high molecular weight polyethylene (UHMWPE), and alloys of these materials.

15. The golf club head of claim 11, wherein a material of the plurality of discontinuous fibers is chosen from a group consisting of carbon, glass, aramid, bamboo, cotton, hemp, flax, titanium, aluminum, titanium dioxide, granite, and silicon carbide.

16. The golf club head of claim 11, wherein the weight structure is co-molded with the rear body.

17. The golf club head of claim 12, wherein the weight structure comprises a metallic material chosen from the group consisting of steel, tungsten, aluminum, titanium, bronze, brass, copper, gold, platinum, lead, silver, and zinc.

18. The golf club head of claim 12, wherein the weight structure comprises a mass between 50 and 80 grams.

* * * * *